US005951319A

United States Patent [19]

Lin

[11] Patent Number: 5,951,319

[45] Date of Patent: Sep. 14, 1999

[54] ISOLATION DISPLACEMENT PIN SEAT AVAILABLE FOR EUROPEAN AND AMERICAN GAUGE WIRING TOOLS

[76] Inventor: Yen-Lin Lin, 3F, No. 9, Lane 144, Jen-Ai Road, Lu-Chou Hsiang, Taipei Hsien, Taiwan

[21] Appl. No.: 08/879,461

[22] Filed: Jun. 20, 1997

[51] Int. Cl.[6] ..... H01R 4/24

[52] U.S. Cl. ..... 439/395

[58] Field of Search ..... 439/395, 396, 439/397, 398, 399, 401–404

[56] References Cited

U.S. PATENT DOCUMENTS 5,584,722 12/1996 Heng et al. ..... 439/395
5,720,625 2/1998 Albeck et al. ..... 439/395

*Primary Examiner*—Neil Abrams
*Assistant Examiner*—Eugene G. Byrd
*Attorney, Agent, or Firm*—Dougherty & Troxell

[57] ABSTRACT

An isolation displacement pin seat, having a clamping and cutting seat provided with an upper portion connected via two arciform surfaces provided respectively on the front and the rear sides. The clamping and cutting seat has a plurality of clamping grooves of suitable height and spaced mutually in a line. Each clamping groove has a pair of recesses to receive an isolation displacement pin. Two front and two rear inner surfaces are left on both sides of the recesses and have, respectively, a pair of tooth like pieces which form a guiding slot. The tooth like pieces of the rear inner surfaces are taller than those of the front inner surfaces or vice versa. The pin seat is available both for European and American gauge wiring tools without limitation of orientation of the wiring tools in use and can effect fit clamping and cutting of conductors.

6 Claims, 10 Drawing Sheets

ISOLATION DISPLACEMENT PIN SEAT AVAILABLE FOR EUROPEAN AND AMERICAN GAUGE WIRING TOOLS

BACKGROUND OF THE INVENTION

1. Field of the Invention

The present invention is related to an isolation displacement pin seat available for European and American gauge wiring tools, and especially to one in which orientation of use of a wiring tool is not limited, and suitable clamping and cutting of conductors can be effected.

2. Description of the Prior Art

An ordinary isolation displacement pin can draw a conductor to the pin through a wiring tool, the conductor is moved into a slit provided on the isolation displacement pin, so that the pin can clamp the conductor in the cut and peeled cover of the insulation covering to complete connection of the conductor.

In using a pin seat for widely used isolation displacement connectors (IDC), including the main European and the American gauge pin seats, completely different wiring tools are required for these two gauges, these tools can only be used singly, i.e., an American gauge wiring tool can only be used for an American gauge pin seat, while an European gauge wiring tool can only be used for an European gauge pin seat, they cannot be interchanged. In use, such limitation results in a wiring tool of certain gauge that must be used for the same gauge of pin seat. This not only is inconvenient in use, but also costs more in that two different gauges of wiring tools must be bought for use.

In view of this, an isolation displacement pin seat was provided available for different gauge wiring tools including the KATT type IDC BLOCK produced by the English company MOD-TAP, which can be used on the AT&T (American gauge), the MOD-TAP and the Krone (European gauge) wiring tools. A Taiwanese patent No. 84217082 titled "ISOLATION DISPLACEMENT CONNECTOR AVAILABE FOR MULTIPLE GAUGE OF WIRING TOOLS" as shown in FIG. 1 also stated that it is suitable for the European and the American gauge wiring tools. However, it has basically some defects. The function as well as its related structures of wiring tools of different gauges are described below in reference to FIG. 1.

As shown in FIG. 1, the conventional pin seat available for multiple gauge wiring tools is provided with a positioning groove 11 to hold therein an isolation displacement pin 12 having a slit thereon. A plurality of recessses 13 are provided on both sides of the body 10 of the pin seat, and an internal guiding plate 14 is provided in each recess 13. The pin seat of such a structure is available for the European gauge wiring tools 20 as shown in FIG. 2 and the American gauge wiring tools 30 as shown in FIG. 3. Basically, the European gauge wiring tool 20 is provided on the top thereof with a sunken portion 22 having two triangular pressing blocks 24, 26 oppositely provided in the middle thereof. Two guiding pieces 28 are provided at the outer ends of the triangular pressing blocks 24, 26, and a clamping mouth 200 is formed between these triangular pressing blocks 24, 26. The American gauge wiring tool 30 is provided on the front and the rear sides thereof with a sunken portion 31 respectively, and a thin sheet 33 is provided in the middle between the two sunken portions 31. The thin sheet 33 is provided at the top thereof with a clamping mouth 35 between two lateral plate portions 37, 39 thereof.

When the above stated isolation displacement pin seat available for different gauge wiring tools is used on one of the above mentioned European gauge wiring tools 20 or American gauge wiring tools 30, the wiring tool (no matter it is an European gauge wiring tool 20 or an American gauge wiring tools 30) must receive a conductor in a specific orientation by pressing. It is because the pin seat uses recesses 13 and internal guiding plates 14 that allows either of these two gauges to be used for engaging therewith. As an example, the European gauge wiring tool 20 is provided with a plain plate 202 at one side on the top thereof as shown in FIG. 2, the plain plate 202 shall be on the right end of the isolation displacement pin seat having the recesses 13 when the conductor is pressed and pierced and connected by a pin. If the tool is turned over 180 degrees to the countrary direction to render the plain plate 202 to be on the left end of the isolation displacement pin seat, it can not be pressed and pierced to be connected by the pin. The orientation in use thereof thus is limited. Operation of electric communication connectors used nowadays are often largely bothered by such limitation of orientation when they have been given with different fixed positions on the products in the production lines.

Further, from the drawings, we can see that operation of such existing isolation displacement pin seat available for different gauge wiring tools includes wire clamping and cutting when a conductor is placed between an isolation displacement pin and a wiring tool to be pressed and pierced for connection. However, the wiring tool and the isolation displacement pin seat are not given consideration of the problem which may be induced in wiring and cutting of the conductor. When the conductor is pressed and pierced and cut, the defects of undue clamping and pressing and incomplete cutting of the conductor may often occur.

SUMMARY OF THE INVENTION

The object of the present invention is to provide an isolation displacement pin seat which can be well used with the above mentioned European gauge wiring tools and American gauge wiring tools, wherein, a clamping and cutting seat with a reduced width is provided as the upper portion of the body of the isolation displacement pin seat and is connected with the lower portion of the body via a front and a rear arciform surfaces. The clamping and cutting seat is provided with a plurality of clamping grooves spaced mutually in a line. Each clamping groove is provided near the center position thereof with a pair of recesses of suitable size in order to receive a plurality of isolation displacement pins. Two front inner surfaces and two rear inner surfaces left on both sides of the recesses are provided respectively with a pair of tooth like pieces, the isolation displacement pin seat thereby can be well used with an European gauge wiring tool or an American gauge wiring tool without limitation of orientation of the wiring tool in use. Moreover, by providing a plurality of round bottoms of the above mentioned clamping grooves for cooperating with the outer round periphery of the conductor, fit clamping as well as positioning of the conductor can be obtained. By providing a plurality of cutting edges which cooperate with an arciform surface of the clamping and cutting seat, perfect cutting of the conductor can be effected.

The present invention will be apparent in its novelty and characteristics after reading the detailed description of the preferred embodiment thereof in reference to the accompanying drawings.

DETAILED DESCRIPTION OF THE PREFERRED EMBODIMENT

Figure 1:
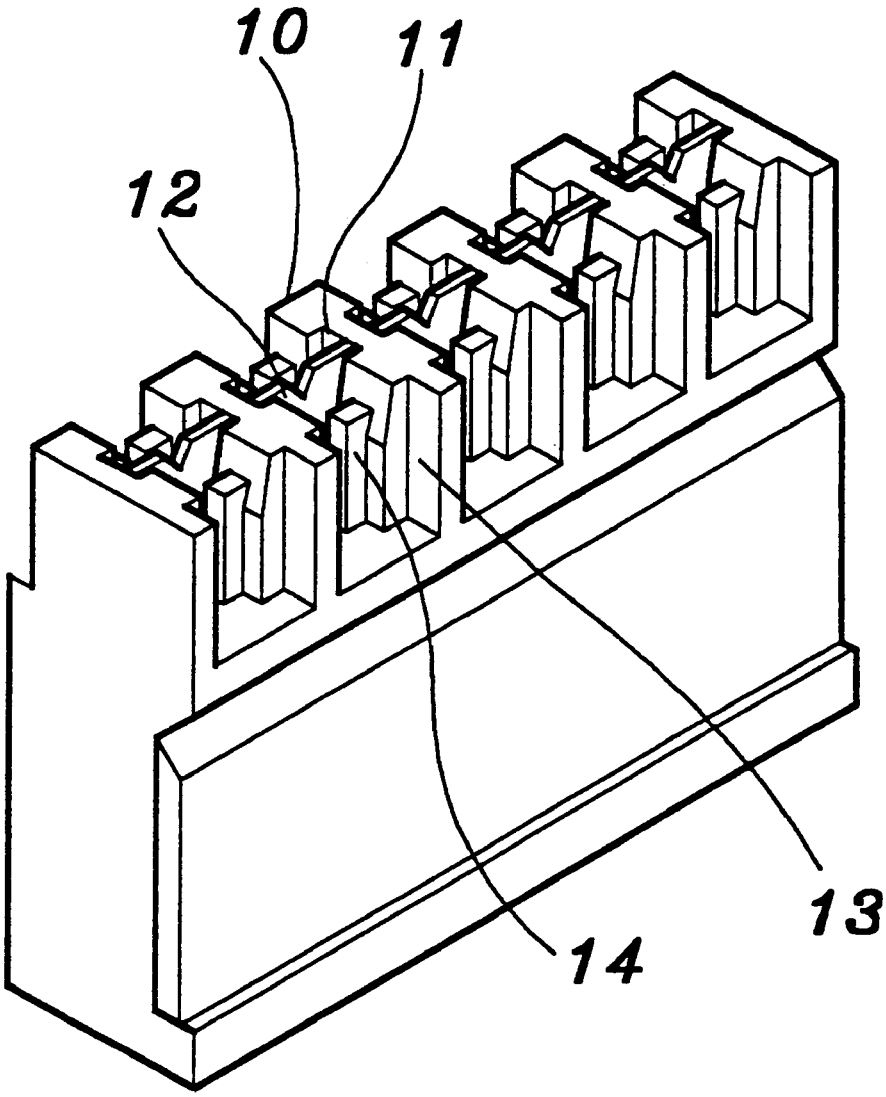
FIG. 1 PRIOR ART
FIG. 1 is a perspective view of a conventional isolation displacement pin seat available for different gauge wiring tools.
Figure 2:
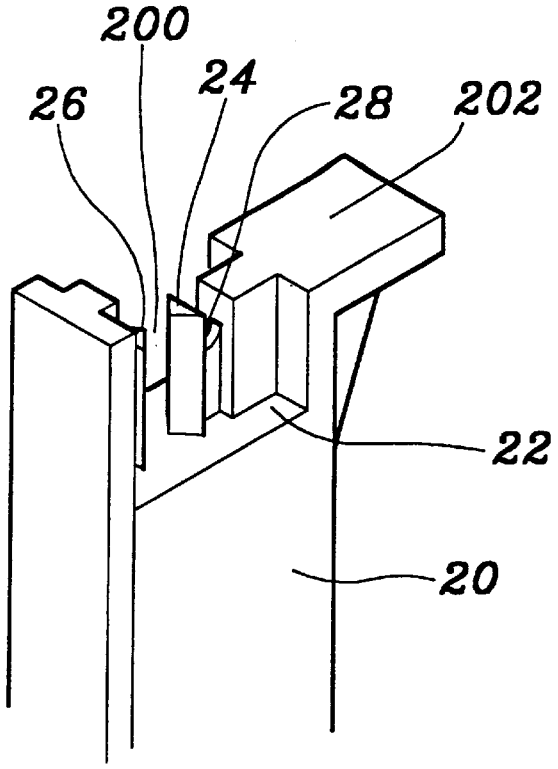
FIG. 2 PRIOR ART
FIG. 2 is a view of an existing European gauge wiring tool.
Figure 3:
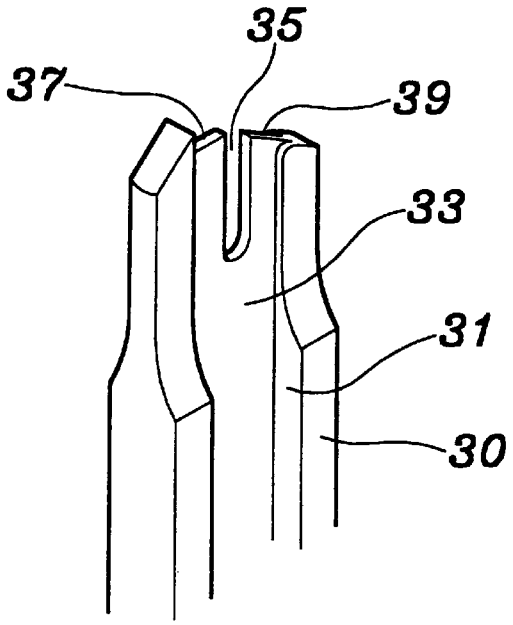
FIG. 3 PRIOR ART
FIG. 3 is a view of an existing American gauge wiring tool.
Figure 4:
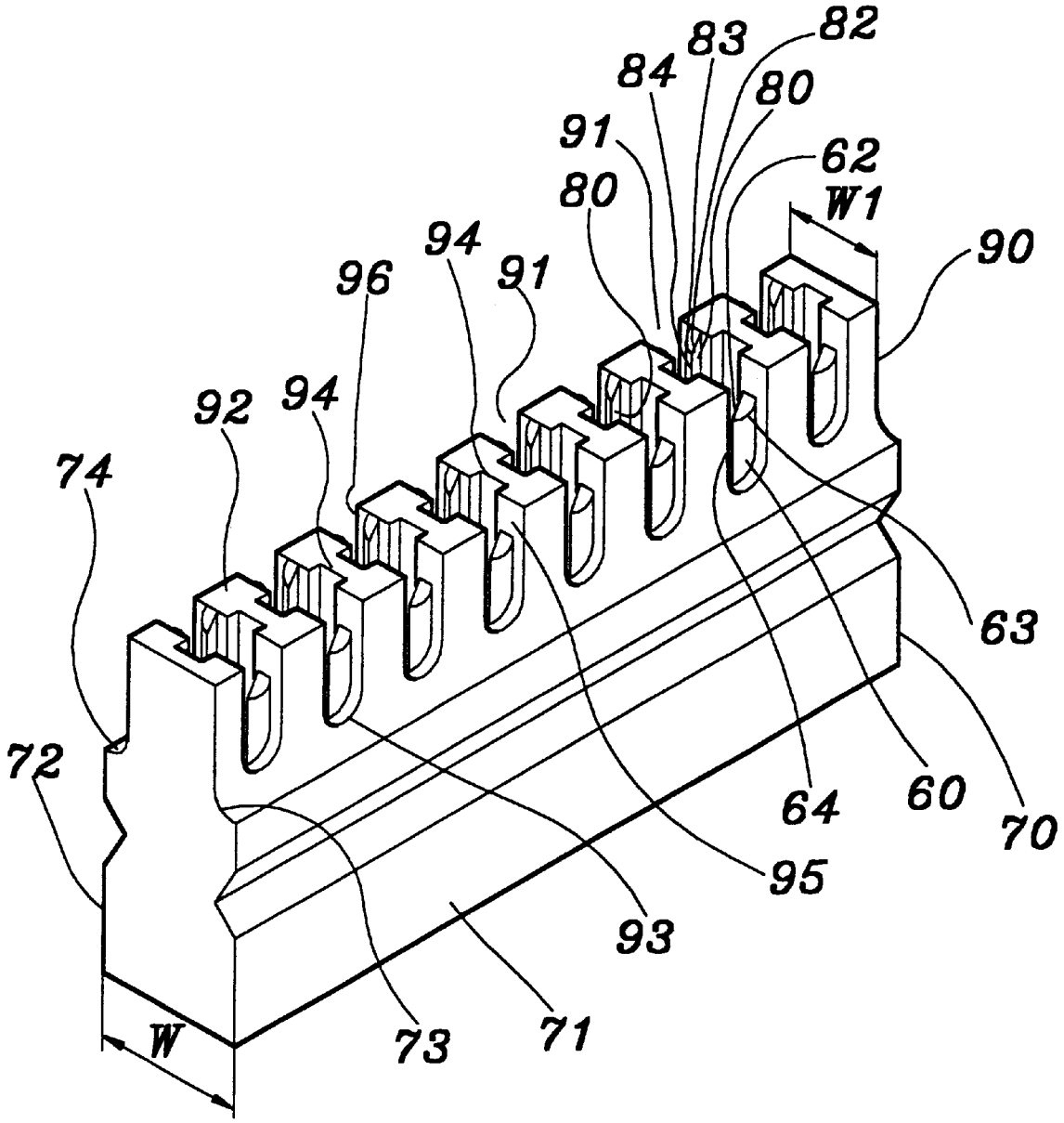
FIG. 4 is a perspective view of an embodiment of the present invention.

Referring to FIG. 4, in the preferred embodiment shown in this drawing, the whole body 70 of the isolation displacement pin seat of the present invention has a front side 71 and a rear side 72 with a suitable width W there between. The upper portion of the body 70 forms a clamping and cutting seat 90 having a slightly reduced width W1. The lower portion of the body 70 is connected with the upper portion—the clamping and cutting seat 90—via two arciform surfaces 73 and 74 which are designed so that the horizontal thickness of the arciform surface 73 is larger than that of the arciform surface 74.

Figure 6:
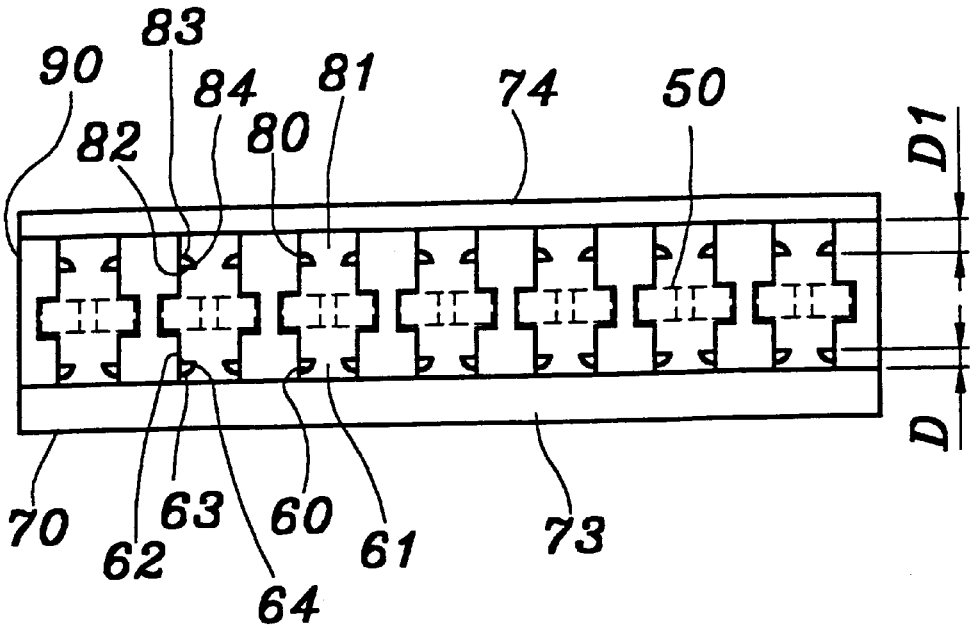
FIG. 6 is a top view of the embodiment in FIG. 4.
Figure 5:
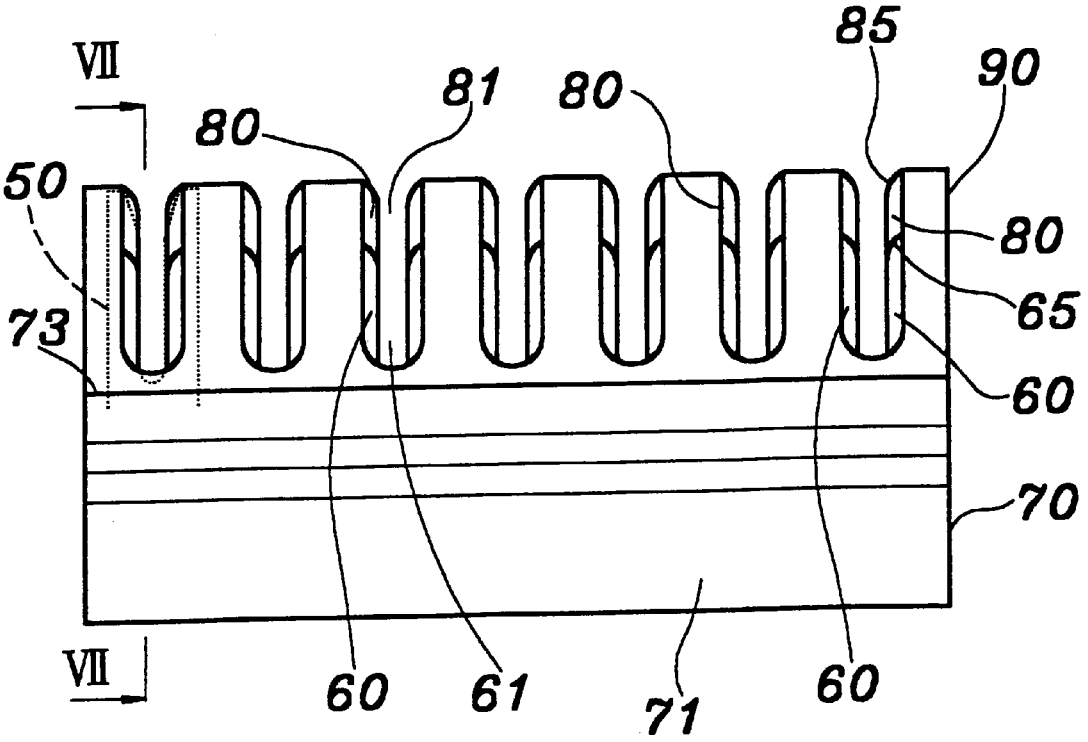
FIG. 5 is a front view of the embodiment in FIG. 4.
Figure 7:
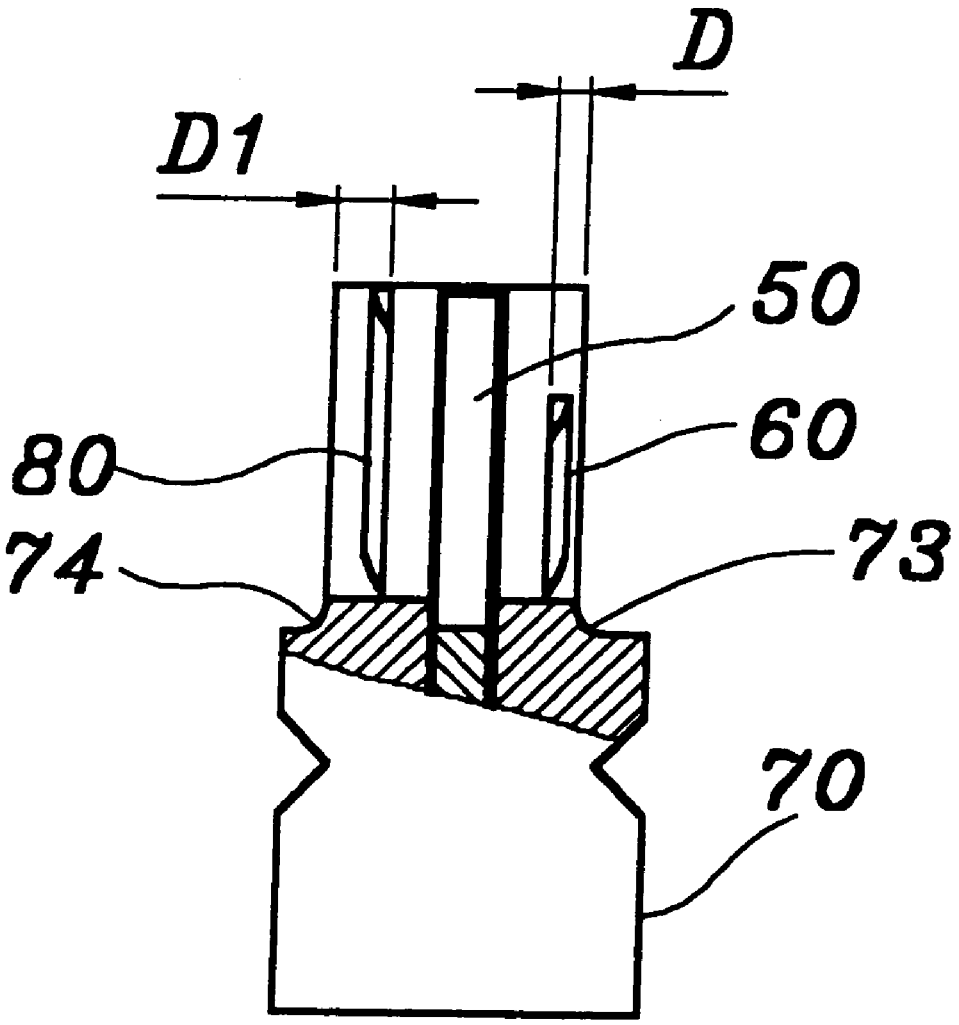
FIG. 7 is a sectional view taken from the section lines VII—VII in FIG. 5.
Figure 8:
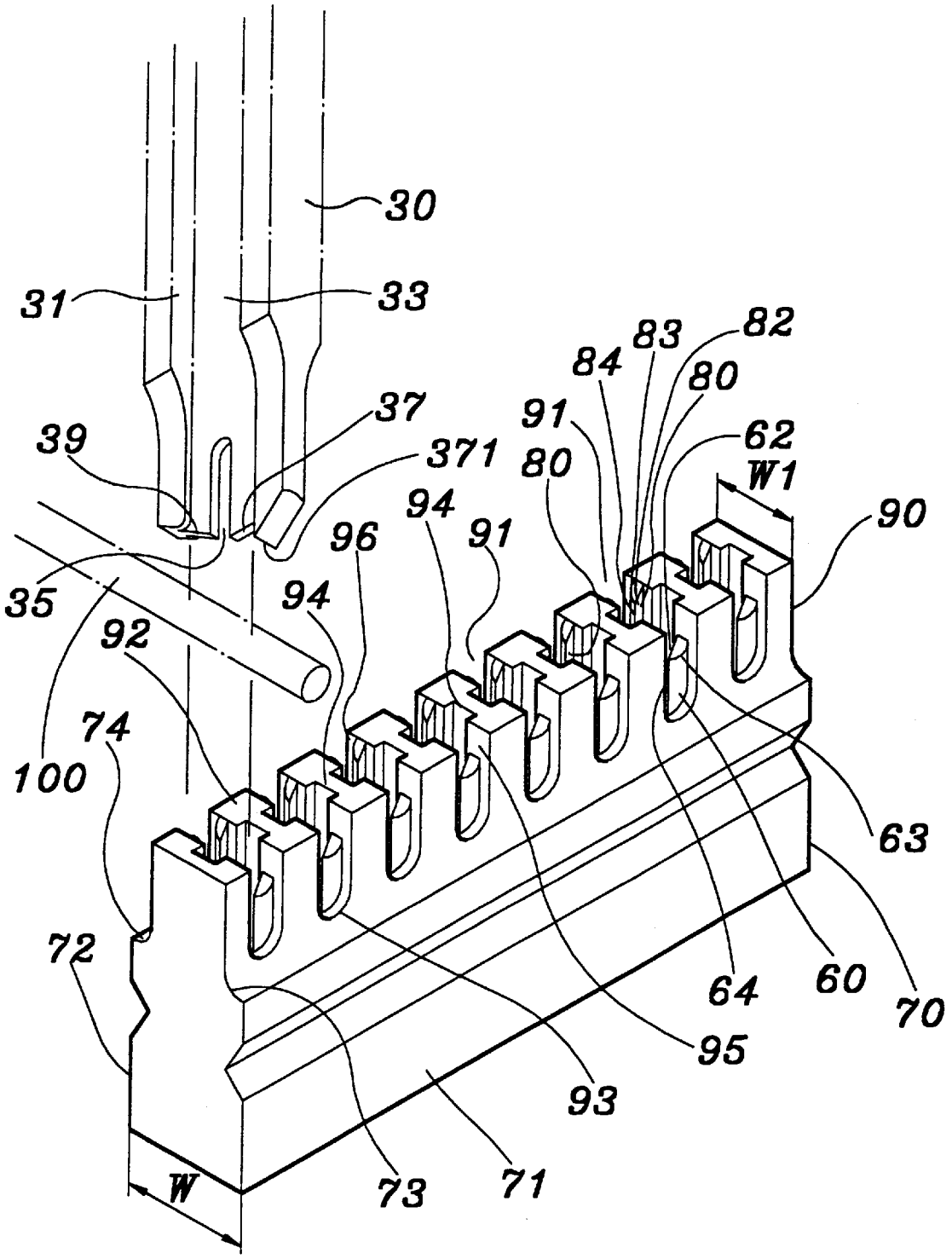
FIG. 8 is a schematic view of the present invention when it uses an American gauge wiring tool for wiring and pressing a conductor.

The clamping and cutting seat 90 mentioned above is provided with a plurality of clamping grooves 91 of suitable width and mutually spaced in a line. The clamping grooves 91 extend from the top surface 92 of the clamping and cutting seat 90 to the location adjacent the two arciform surfaces 73 and 74 and are formed with round bottoms 93. Each clamping groove 91 is provided near the center position thereof with a pair of recesses 94 with their width larger than their depth in order to receive an isolation displacement pin 50 (referring to FIG. 6). Two front inner surfaces 95 and two rear inner surfaces 96 are left on both sides of the recesses 94.

Referring now to FIG. 4, 5, 6 and 7 simultaneously, the above mentioned front inner surfaces 95 and rear inner surfaces 96 are provided respectively with a pair of tooth like pieces 60, 80 of which each pair forms a guiding slot 61, 81. As shown in the preferred embodiment, the tooth like pieces 60, 80 are provided each with an inner plain surface 62, 82 and an outer arciform surface 63, 83 to thereby form their respective tip ends 64, 84.

In the preferred embodiment shown in the drawings, the tooth like pieces 80 of the rear inner surfaces 96 are taller than the tooth like pieces 60 of the front inner surfaces 95, the tooth like pieces 60, 80 are all provided with arciform tops 65, 85. The tooth like pieces 80 of the rear inner surfaces 96 are extended down to the round bottoms 93 from the top surface 92 of the clamping and cutting seat 90, while the tooth like pieces 60 of the front inner surfaces 95 are extended down to the round bottoms 93 from a level below the top surface 92. The tooth like pieces 60 of the front inner surfaces 95 are provided at the locations with a depth D from the front surface of the clamping and cutting seat 90, while the tooth like pieces 80 of the rear inner surfaces 96 are provided at the locations with a larger depth D1 from the rear surface of the clamping and cutting seat 90.

Figure 10:
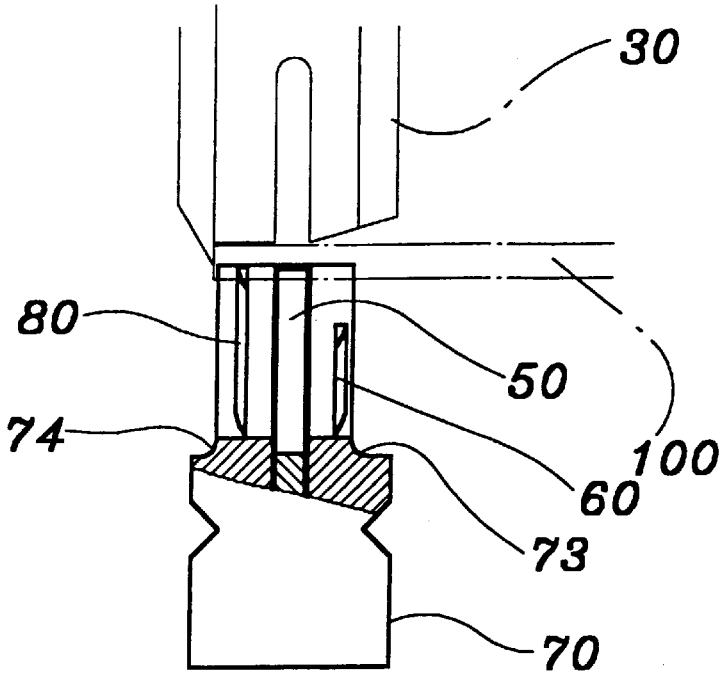
FIG. 10 is a side view showing the state before pressing of the conductor of FIG. 8.
Figure 11:
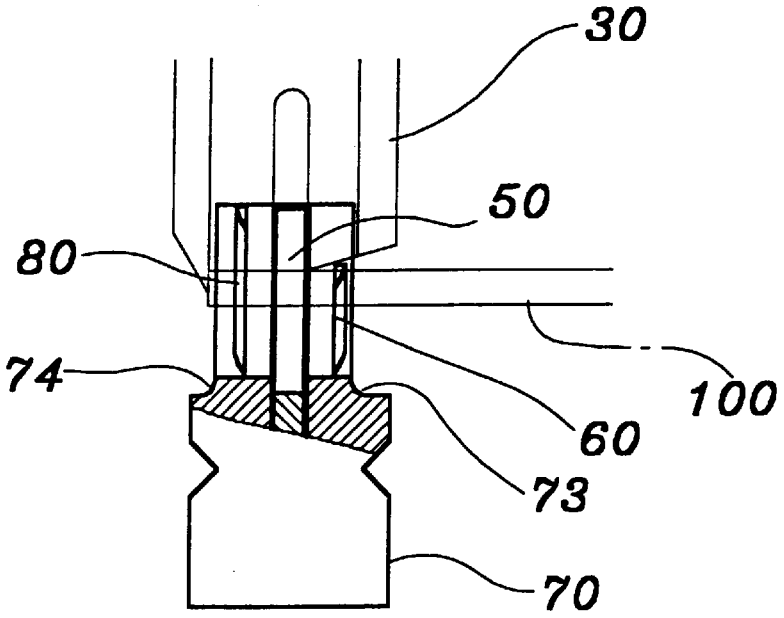
FIG. 11 is a side view showing the state after press connecting of the conductor of FIG. 8.
Figure 12:
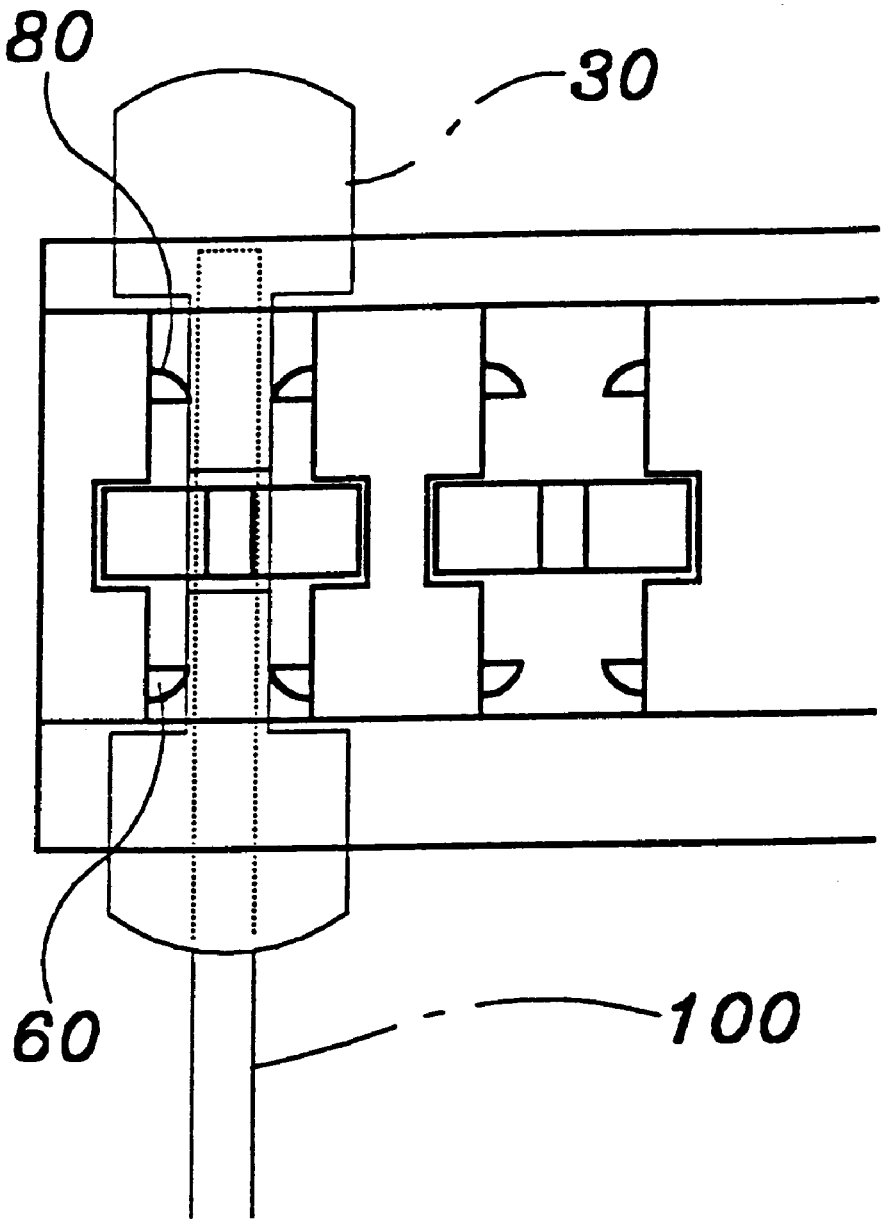
FIG. 12 is a top view of the embodiment in FIG. 8.

Taking the case using an American gauge wiring tool 30 as an example, and as shown in FIGS. 8, 10, 11 and 12, a conductor 100 is placed between the wiring tool 30 and the clamping and cutting seat 90 on the upper portion of the body 70. The conductor 100 is placed firstly between the two arciform tops 85 of the tooth like pieces 80 of the two rear inner surfaces 96 which are taller as stated before. When the wiring tool 30 is pressed down as shown in FIG. 11, the thin sheet 33 provided at the lateral middle place of the wiring tool 30 is guided by the guiding slots 61, 81 formed by the tooth like pieces 60, 80. Further with cooperation of the two lateral plate portions 37, 39 of the wiring tool 30 and the clamping mouth 35 therebetween together with an isolation displacement pin 50, the cover of the conductor 100 is peeled, then the conductor 100 is pressed down to the round bottoms 93. A cutting edge 371 provided on the lateral plate portion 37 cooperating with the arciform surface 73 provided on the front surface of the clamping and cutting seat 90 can thereby cut the end of the conductor 100. Thus the operation of piercing, cutting as well as connecting can be completed.

It can be seen from FIGS. 10 and 11 that, the American gauge wiring tool 30 can still be used to connect the conductor 100 onto the isolation displacement pin seat by pressing even if it is turned over for 180 degrees in use.

Figure 9:
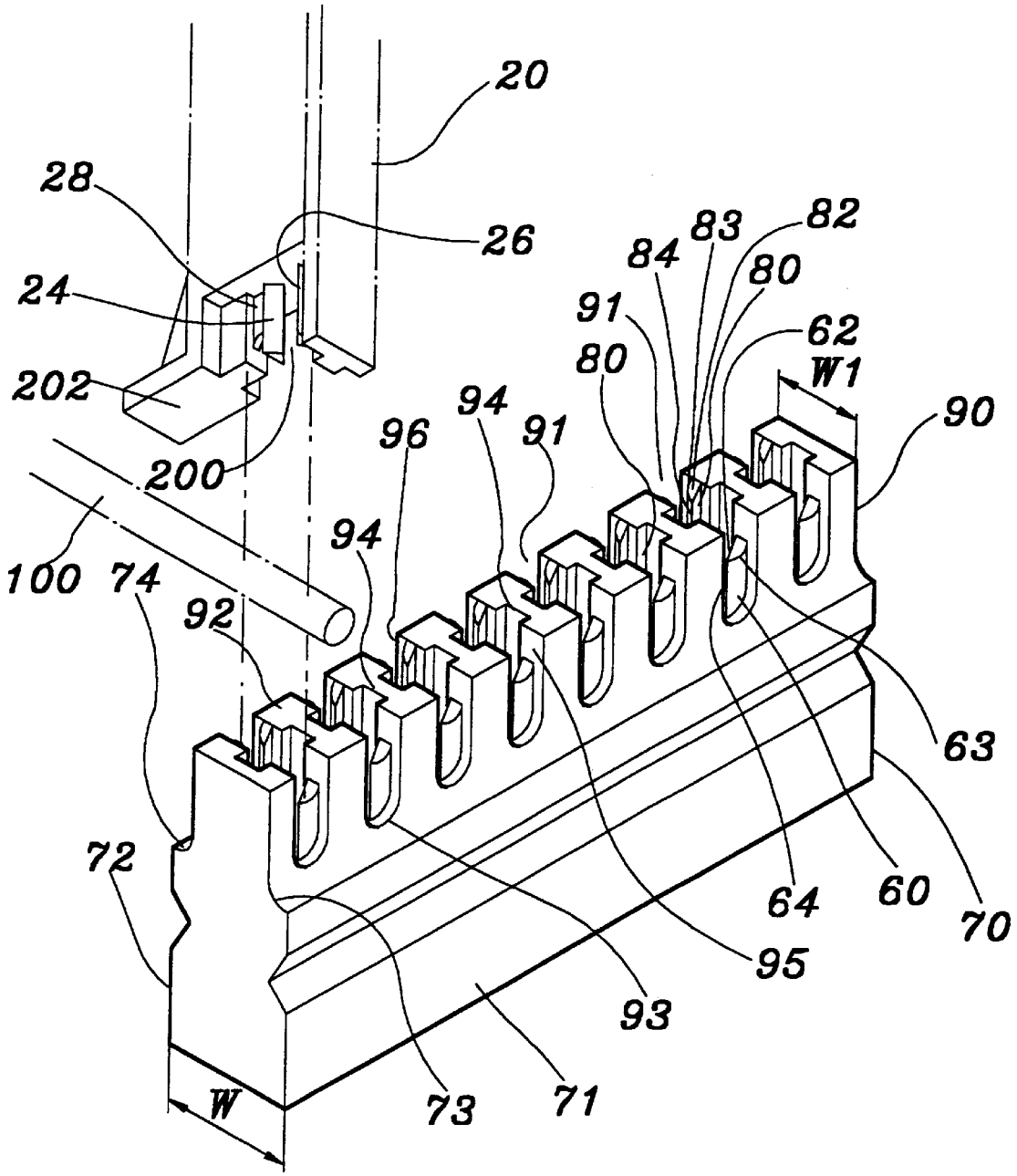
FIG. 9 is a schematic view of the present invention when it uses an Europian gauge wiring tool for wiring and pressing a conductor.
Figure 13:
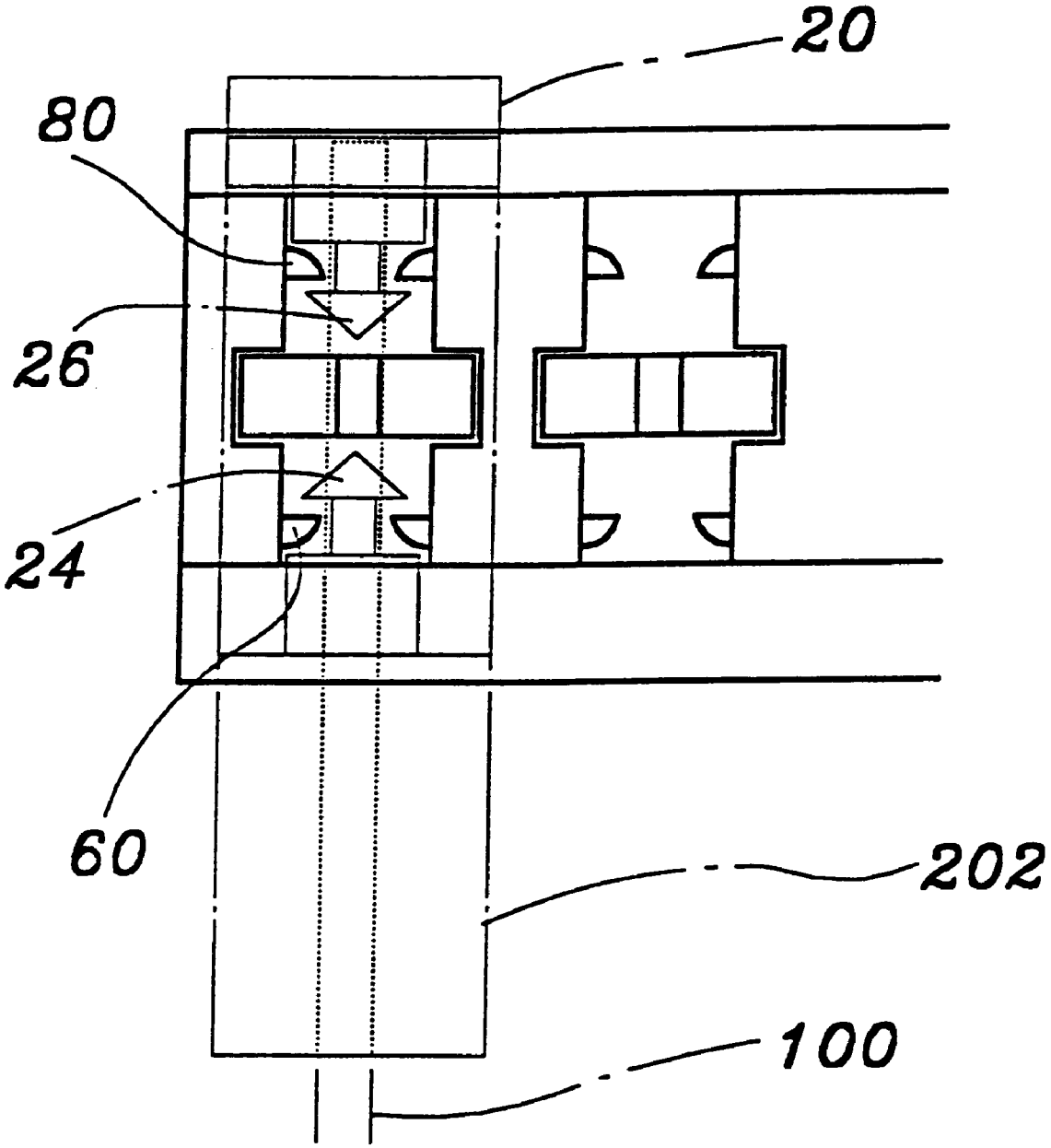
FIG. 13 is a top view of the embodiment in FIG. 9.

Similarly, when an European gauge wiring tool 20 is used to be pressed down as is shown in FIGS. 9 and 13, the two triangular pressing blocks 24, 26 are located between two front and rear tooth like pieces 60, 80. The outer guiding pieces 28 thereon are positioned in the guiding slots 61, 81 formed by the front and rear tooth like pieces 60, 80, so that the insulation cover of the conductor 100 is pierced by contact and pressing of the internal isolation displacement pin thereagainst, and the conductor 100 is cut by further pressing. According to FIG. 13, the European gauge wiring tool 20 can still be used to connect the conductor 100 onto the isolation displacement pin seat by pressing even if it is turned over for 180 degrees in use, i.e., it is not limited by its orientation in use.

Moreover, during press connecting and cutting of the conductor 100 normally with an insulation cover used on the isolation displacement pin seat of the present invention, the defect of incomplete cutting of the conductor 100—in that the conductor is only pressed flat rather than cut—can be totally eliminated by providing the round bottoms 93 which cooperates with the outer round periphery of the conductor 100 to clamp as well as position the conductor 100 and by providing the cutting edge 371 which cooperates with the arciform surface 73 or 74 to make perfect cutting of the conductor 100.

In conclusion, the present invention not only can be well used with the above mentioned European gauge wiring tools 20 or American gauge wiring tools 30, the orientation of the wiring tool relative to the isolation displacement pin seat of the present invention has no specific limitation in use. Operation thereof thus is much more convenient and mobile. The capability of cutting on either side of the isolation displacement pin seat makes it more acceptable in use.

Having thus described the technical structure of my invention with industrial value, what I claim as new and desire to be secured by Letters Patent of the United States is:

1. An isolation displacement pin seat for use with both European and American gauge wiring tools and comprising a body having an upper portion forming a clamping and cutting seat, a lower portion, a concavely arcuate surface joining the upper and lower portions on both front and rear sides of the body; a plurality of clamping grooves extending through the upper portion of the body between the front and rear sides thereof, each clamping groove bounded by two side surfaces, the two side surfaces each having a recess therein configured to receive an isolation displacement pin; a first pair of tooth elements located in each clamping groove between the front side of the body and the recesses in the associated clamping groove; and a second pair of tooth elements located in each clamping groove between the rear side of the body and the recesses in the associated clamping groove, whereby the first pair of tooth elements bound opposite sides of a first guiding slot, the second pair of tooth elements bound opposite sides of a second guiding slot, and the heights of the second pair of tooth elements measured from a bottom of the associated clamping groove are greater than corresponding heights of the first pair of tooth elements.

2. The isolation displacement pin seat for European and American gauge wiring tools as stated in claim 1, wherein, each of said tooth elements have an inner plane surface and an outer convexly arcuate surface.

3. The isolation displacement pin seat for European and American gauge wiring tools as stated in claim 1, wherein, said second pairs of tooth elements extend downwardly to the bottoms of said clamping grooves from a top surface of said clamping and cutting seat, and said first pairs of said tooth elements extend downwardly to the bottoms of said clamping grooves from a level below said top surface of said clamping and cutting seat.

4. The isolation displacement pin seat for European and American gauge wiring tools as stated in claim 1, wherein, each of said tooth elements have convexly arcuate tops.

5. The isolation displacement pin seat for European and American gauge wiring tools as stated in claim 1, wherein, each of said clamping grooves have a round bottom.

6. The isolation displacement pin seat for European and American gauge wiring tools as stated in claim 2 wherein a distance D between the front side of the body and the plane surfaces of the plurality of first pairs of tooth elements is less than a distance D1 between the rear side of the body and the plane surfaces of the plurality of second pairs of tooth elements.

* * * * *